US007009631B2

(12) United States Patent
Fukui

(10) Patent No.: US 7,009,631 B2
(45) Date of Patent: Mar. 7, 2006

(54) METHOD OF SMOOTHING SURFACE OF PRINTING PAPER, SMOOTHING APPARATUS AND PRINTER WITH THE SMOOTHING APPARATUS

(75) Inventor: Daisuke Fukui, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 10/736,828

(22) Filed: Dec. 16, 2003

(65) Prior Publication Data

US 2004/0165052 A1 Aug. 26, 2004

(30) Foreign Application Priority Data

Dec. 17, 2002 (JP) ..... 2002-364619

(51) Int. Cl.
*B41J 2/325* (2006.01)

(52) U.S. Cl. ..... 347/212; 400/120.18

(58) Field of Classification Search ..... 347/212, 347/171–176; 400/120.08
See application file for complete search history.

(56) References Cited

U.S. PATENT DOCUMENTS 5,220,343 A * 6/1993 Takanashi et al. ..... 347/212
5,851,720 A * 12/1998 Shinohara ..... 430/201
5,907,348 A * 5/1999 Ogasawara et al. ..... 347/212
2003/0165753 A1 * 9/2003 Suzuki et al. ..... 430/14

FOREIGN PATENT DOCUMENTS

| | | | |
|---|---|---|---|
| JP | 59-215885 | * 12/1984 | ..... 347/212 |
| JP | 05069678 | 3/1993 | |
| JP | 06336043 | 12/1994 | |
| JP | 08328404 | 12/1996 | |
| JP | 09193433 | 7/1997 | |
| JP | 10-86420 | 4/1998 | |
| JP | 10291332 | 11/1998 | |
| JP | 2002-113958 | 4/2002 | |

* cited by examiner

*Primary Examiner*—Huan Tran
(74) *Attorney, Agent, or Firm*—Ladas & Parry LLP

(57) ABSTRACT

A method of smoothing the surface of printing paper formed by a thermal head is provided. A printer forms a protection layer on images of the printing paper by the heat of a thermal head that has a plurality of heat generating potions arrayed apart from each other. The printer has a line heater that, on a downstream side of the thermal head in the feeding direction of the printing paper, has a heat generating portion that continuously extends over a length corresponding to the plurality of heat generating portions of the thermal head, the heat generating portion being disposed so as to contact with the protection layer

5 Claims, 5 Drawing Sheets

METHOD OF SMOOTHING SURFACE OF PRINTING PAPER, SMOOTHING APPARATUS AND PRINTER WITH THE SMOOTHING APPARATUS

BACKGROUND OF THE INVENTION

1. Field of the Invention

The present invention relates to a method of smoothing the surface of printing paper, a smoothing apparatus, and a printer with the smoothing apparatus.

2. Description of the Related Art

In printing by heat transfer, a protection layer for protecting an ink layer is also transferred along with the ink layer. Ordinarily, the protection layer is transferred by the heat of a thermal head. Further, a technique for transferring the protection layer by the heat of a line heater is also known (described in Granted Japanese Patent No. 3314980).

Incidentally, a technique for re-heating the ink layer after transferred for the purpose of making the ink monomolecular and thereby increasing its resistance to light is also known (described in Japanese Patent Application Laid-Open No. 5-69678). For this re-heating, a heating roller is used.

However, if the protection layer is transferred by a thermal head, since the thermal head is formed by arraying a plurality of heat generating portions corresponding to the pixels, the protection layer comes to have portions therein that are located at the heat generating portions and have portions therein that are located between the heat generating portions. For this reason, there are the problems such that the heat applied to the protection layer is not uniform, and thus concavo-convex portions occur in the protection layer and, therefore, the luster was lost.

SUMMARY OF THE INVENTION

Thereupon, the present invention has an object to provide a method capable of smoothing the surface of printing paper formed by a thermal head.

Hereafter, the present invention will be explained.

In order to achieve the above object, one aspect of the present invention provides a method of smoothing a surface of printing paper, which smoothes a protection layer formed on images of printing paper by heat of a thermal head having a plurality of heat generating portions arrayed apart from each other, the method comprising the steps: disposing a line heater having a heat generating portion that continuously extends over a length corresponding to the plurality of heat generating portions of the thermal head, so that the heat generating portion may contact with the protection layer; and relatively moving the line heater and the printing paper, while causing generation of heat from the heat generating portion of the line heater.

As described above, when the protection layer is formed by the thermal head, since this thermal head is discontinuously provided therein the heat generating portions, the heat applied to the protection layer is not uniform. Thus, concavo-convex portions occur on the surface of the protection layer. On the other hand, the line heater is provided therein a single heat generating portion that has a length corresponding to the plurality of heat generating portions of the thermal head. Therefore, it is possible, by disposing the line heater so as to contact with the protection layer and, while causing generation of heat from its heat generating portion, relatively moving the line heater and printing paper, to soften, flatten, and level those concavo-convex portions. Accordingly, it is possible to make smooth the surface of the printing paper and therefore improve the luster of the printing paper. Furthermore, since using the line heater, comparing to the case where a roller for heating is used, there are various merits including that of enabling faster generation of heat, that of enabling lessening the power consumption, that of enabling miniaturizing the heater, and that of enabling making narrow the area of its contacting with the printing paper and thereby increasing the pressure of pressing that paper.

In the method of smoothing printing paper according to the present invention, releasability may be imparted to the protection layer. In this case, when mutual rub occurs between the heat generating portion of the line heater and the protection layer, since that protection layer is easily released from that heat generating portion, it is possible to more increase the accuracy of smoothing.

In order to achieve the above object, another aspect of the present invention provides an apparatus for smoothing a surface of printing paper, which smoothes a protection layer formed on images of printing paper by heat of a thermal head having arrayed therein at space intervals from one another a plurality of heat generating portions, the apparatus comprising: a line heater having a heat generating portion that continuously extends over a length corresponding to the plurality of heat generating portions of the thermal head and that is disposed so that the heat generating portion may contact with the protection layer; and a device that relatively moves the line heater and the printing paper. According to the smoothing apparatus of the present invention, it is possible to realize the above-described method of smoothing.

In order to achieve the above object, still another aspect of the present invention provides a printer that forms a protection layer on images of printing paper by heat of a thermal head having a plurality of heat generating portions arrayed apart from each other, the printer comprising: a line heater that, on a downstream side of the thermal head in the feeding direction of the printing paper, has a heat generating portion that continuously extends over a length corresponding to the plurality of heat generating portions of the thermal head, the heat generating portion being disposed so as to contact with the protection layer. According to the printer of the present invention, it is possible to smooth the surface of printing paper by using the above smoothing method and thereby obtain the printing paper, the luster of which has been improved.

In the printer according to the present invention, the line heater may be provided in such a way as to extend over the entire width of the printing paper. In this case, if only once causing the printing paper to pass on the line heater, that paper can be made smooth. Therefore, it is possible to quickly make that paper smooth. In addition, since the line heater extends in a direction perpendicular to the direction in which the paper is fed, simply feeding the printing paper out along the feeding direction thereof enables smoothing the printing pater. Thus, the configuration of the printer can be simplified.

DESCRIPTION OF THE PREFERRED EMBODIMENTS

Figure 1:
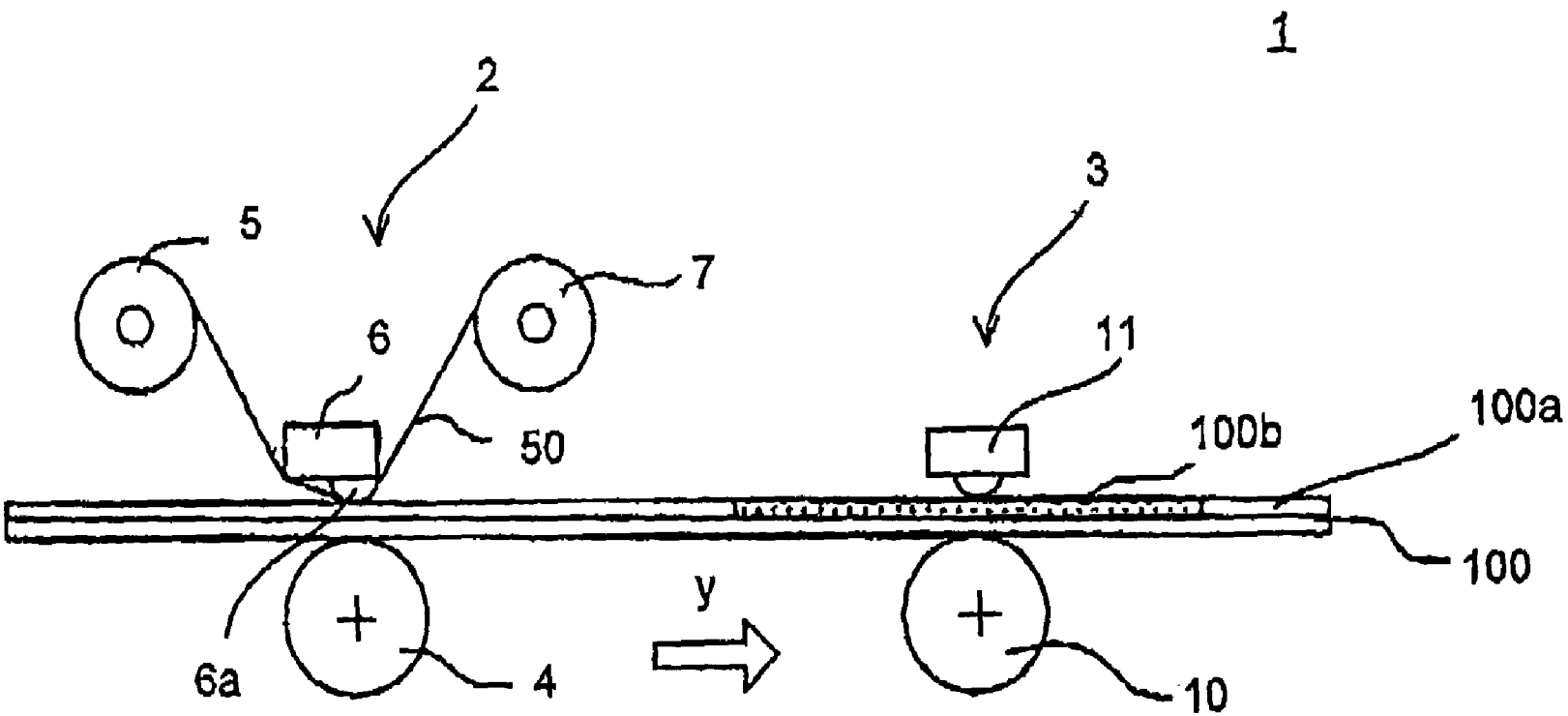
FIG. 1 is a side view illustrating the outline of a printer according to an embodiment of the present invention.
Figure 2:
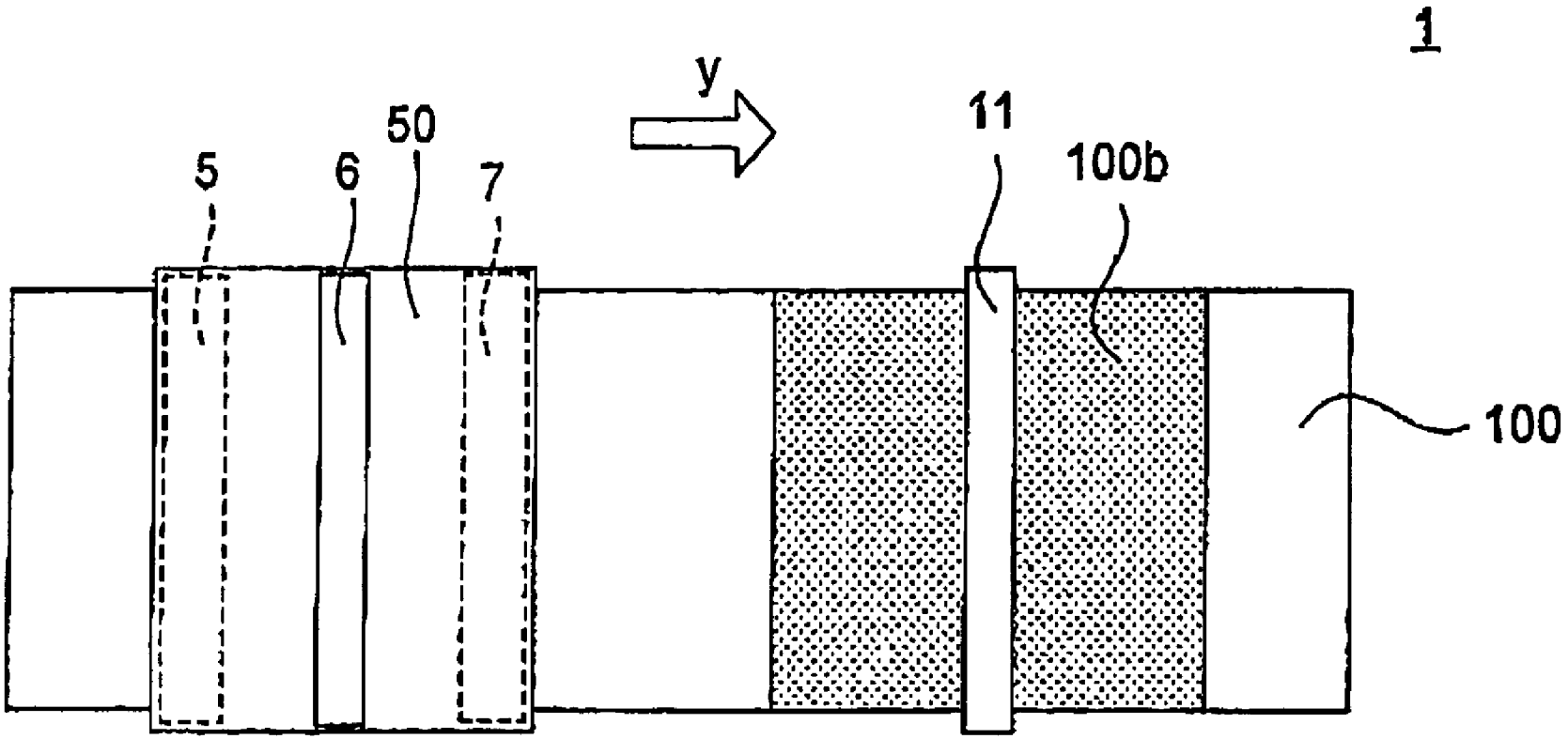
FIG. 2 is an upper surface view illustrating the outline of the printer illustrated in FIG. 1.

FIGS. 1 and 2 illustrate the outline of a printer according to an embodiment of a method of smoothing of the present invention. FIG. 1 is a side view, and FIG. 2 is an upper surface view. The printer 1 is configured as a sublimation heat-transfer type printer that heat-transfers the ink of a transfer film 50 onto an image-receiving paper (printing paper) 100 to form an image The image-receiving paper 100 is attached to the printer 1 in the state where it is wound like, for example, a roll and it is drawn out from the roll by the quantity necessary for printing. The printer 1 has a printing section 2 and smoothing section 3 on a conveyance passage for the image-receiving paper 100 drawn out from the roll.

Figure 3A:
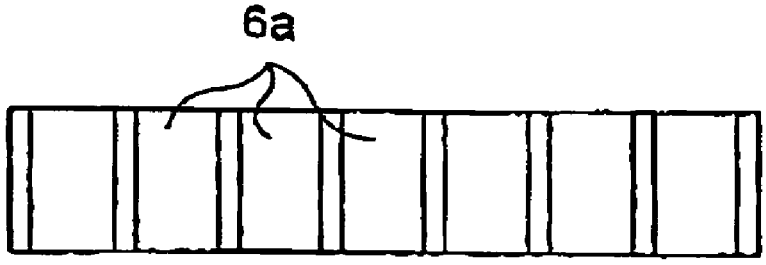
FIGS. 3A and 3B are views illustrating respective heat generating portions of a thermal head and line heater of the printer illustrated in FIG. 1.

The printing section 2 is provided therein a platen roll 4 that conveys the image-receiving paper 100 while it supports this image-receiving paper 100, a feed roll 5 that has wound therearound a not-already-used heat-transfer film 50, a thermal head 6 that heats the heat-transfer film 50 that has been delivered from the feed roll 5, and a wind-up roll 7 that takes up the heat-transfer film 50 that has been heated by the thermal head 6. On the underside of the thermal head 6, as conceptually shown in FIG. 3A, a plurality of heat generating portions 6*a*, . . . 6*a* are arranged apart from each other. The heat generating portions 6*a*, . . . 6*a* correspond to the pixels of an original printing matter and their temperatures are made controllable for each of the heat generating portions 6*a*. The heat generating portions 6*a* . . . 6*a* are provided, for example, 12 pieces per 1 mm. For the thermal head 6, any known structure of thermal head can be used, and at each of the space between adjacent two of the heat generating portions 6*a* . . . 6*a*, a notch may be provided or a separate member such as a heat-insulating material may be provided.

The smoothing section 3 illustrated in FIGS. 1 and 2 is provided, for example, at a discharging part of the printer 1. In the smoothing section 3, there are provided a platen roll 10 that conveys the image-receiving paper 100 while it supports that paper 100 and a line heater 11 that heats the image-receiving paper 100. The platen roll 10 and line heater 11 are disposed so as to be in a direction perpendicular to the direction in which the paper is fed, the direction being indicated by the arrow y, and are extended over the entire width of the image-receiving paper 100. Also, the platen roll 10 and line heater 11 are disposed so that they can press the image-receiving paper 100 in such a manner as to sandwich the image-receiving paper 100 with a predetermined level of pressure. For example, they can press the image-receiving paper 100 under a pressure that is the same extent of 20 to 30N as the printing pressure of a general thermal head. Incidentally, the platen roll 10 or line heater 11 may be attached so that its vertical position can be controlled by a driving device such as a motor so that its pressure of pressing the image-receiving paper 100 can be adjusted. Alternatively, it may be attached so that it can be rocked via, for example, an elastic member so that it can mechanically press the image-receiving paper 100 under a predetermined level of pressure. Alternatively, the platen roll 10 and line heater 11 may be attached so that each of their vertical positions may be fixed to a fixed position.

Figure 3B:
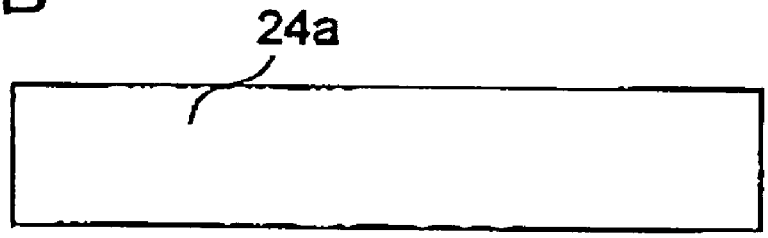
Figure 4A:
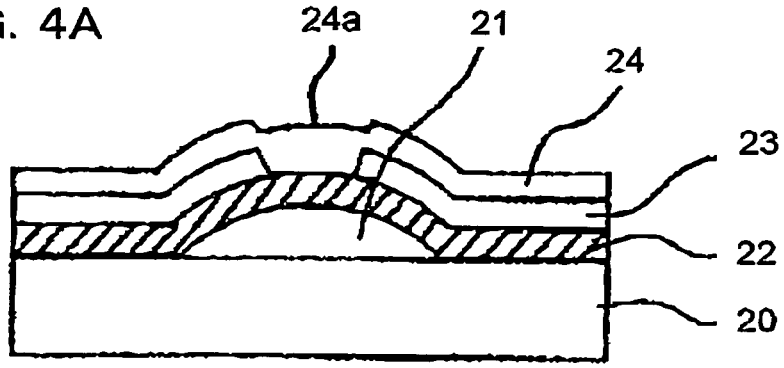
FIGS. 4A and 4B are views illustrating configurations of the line heater of the printer illustrated in FIG. 1.
Figure 4B:
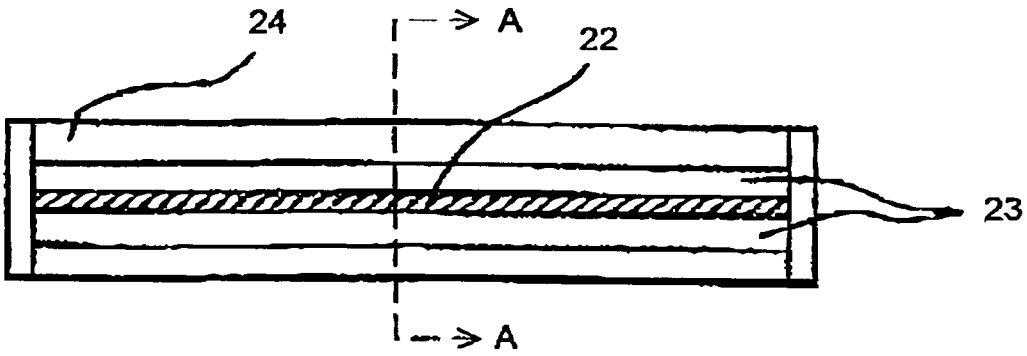

The line heater 11 is configured as illustrated in FIG. 4. FIG. 4A is a sectional view taken along a line A—A of FIG. 4B. FIG. 4B is a plan view, partly broken away, of the line heater 11, taken from above FIG. 4A. It is to be noted that the upper part of FIG. 4A corresponds to the lower part of FIG. 1. The line heater 11 is configured as a thin-film type line heater having laminated on its heat dissipation substrate 20, a heat-resisting layer 21, a heat-generating resistor 22, electrodes 23, and a wear-resisting layer 24. The heat-resisting layer 21 is formed as a convex shape of portion on and at the central part of the heat-dissipation substrate 20. Accordingly, the heat generating resistor 22, etc. laminated on it are formed in the way that they rise at the center. The electrodes 23 are disposed so that they clamp the apex portion of that rise of the heat generating resistor 22. A portion of the wear-resisting layer 24 corresponding to the spacing between the electrodes 23 functions as a heat generating portion 24*a*. The heat generating portion 24*a*, as illustrated in FIG. 3B, extends over a length corresponding to the plurality of heat generating portions 6*a*, . . . 6*a* of the thermal head. In this embodiment, the heat generating portion 24*a* extends over a length corresponding to the entire width of the thermal head, For the heat dissipation substrate 20, for example, ceramics is used. For the heat-resisting layer 21, for example, glass is used. For the heat generating resistor 22, for example, $Ta_2N$, W, Cr, Ni—Cr, $SnO_2$, etc. are used. The heat generating resistor 22 is formed, like a line, using a thin-film configuration technique such as vacuum deposition, CVD, sputtering, etc. For the electrode 23, for example, Al is used. For the wear-resisting layer 24, for example, $Ta_2O_3$, $Si_3N_4$, SiC, etc are used. Furthermore, by providing on the electrode 23 side a layer that consists of $SiO_2$ or the like and that has an oxidation-resisting layer, the wear-resisting layer 24 maybe formed into a two-layer structure.

Supplying an electric current to the heat generating resistor 22 via the intermediary of the electrodes 23 causes heat to be generated at the portion clamped between the left and right electrodes 23. Accordingly, it is possible to heat the paper-receiving paper 100 via the heat generating portion 24*a*. About the line heater 11, as the heat-resisting layer 21 located under the heat generating portion is formed thickly, the leakage of the heat to the heat-dissipation substrate 20 side is less, and the efficient heating of the image-receiving paper 100 is possible. Incidentally, by detecting the temperature by disposing a thermistor above or below the heat-dissipation substrate 20 the temperature of the line heater 11 may be made accurately controllable.

In FIG. 1, the image-receiving paper 100 has an image-receiving layer 100*a* on its upper surface. The transfer film 50 has sequentially provided therein in a direction counter to the feeding direction of paper, for example, ink areas of Yellow (Y), Magenta (M), and Cyan (C) and an area of overprint (OP) layer.

The operation of the printer 1 having the above-described configuration will now be explained. When the image-receiving paper 100 is conveyed to the area under the thermal head 6 by the platen roller 4, the image-receiving paper 100, along with the transfer film 50, is pressed between the platen roller 4 and the thermal head 6, in such a way that it is clamped between the both. The Y, M, and C inks are adhered to the image-receiving layer 100*a* of the image-receiving paper 100 by heat-generation controlling each heat generating portion 6*a*, . . . 6*a*. As a result of this, of the images that plan to be printed, the portion corresponding to a 1 line of pixels is formed.

Figure 5A:
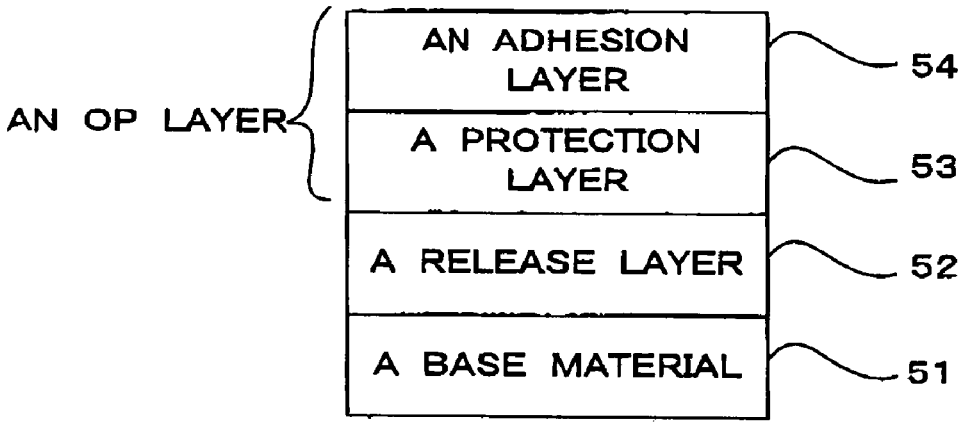
FIGS. 5A and 5B are views illustrating configurations of a transfer film and image-receiving paper.
Figure 5B:
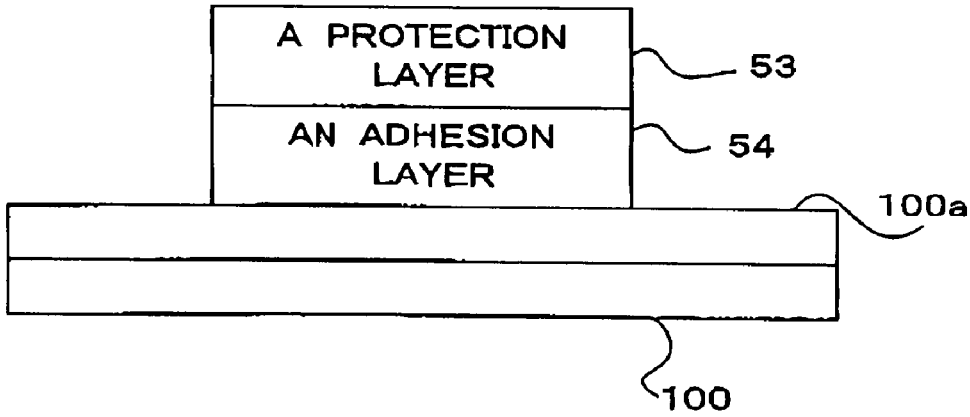

Thereafter, the printer 1 transfers the OP layer onto the 1 line of pixel image by heat-generation controlling the heat generating portions 6*a*, . . . 6*a*. As illustrated in FIG. 5A, the OP layer has a protection layer 53 and adhesion layer 54. Further, a release layer 52, the protection layer 53, and the adhesion layer 54 are laminated on a base material 51 of the transfer film 50 in this order so that the OP layer is provided on the transfer film 50. Accordingly, as illustrated in FIG. 5B, the protection layer 53 and adhesion layer 54 are transferred onto the image-receiving paper 100. Incidentally, the upper part of FIG. 5A corresponds to the lower part of FIG. 1. Also, the release layer 52 may not be provided.

The printer 1 intermittently conveys the image-receiving paper 100, by the platen roller 4, by the portion thereof corresponding to the 1 line of pixels. Further, by repeatedly performing transfer of the 1 line of pixel ink and protection layer 53, the printer 1 forms images on a predetermined area 100*b* and simultaneously transfers the protection layer 53 on those images.

Since the heat generating portions 6*a*, . . . 6*a* are provided in space intervals from one another, the heating temperatures taken in the direction that goes along the thermal head 6 are not uniform. Therefore, concavo-convex portions are formed in the width direction of the protection layer 53 that has been transferred to the image-receiving paper 100. Further, since the protection layer 53 is transferred while the image-receiving paper 100 is shifted relative to the thermal head by the quantity corresponding to one line, the protection layer 53 also has concavo-convex portions formed in the feeding direction, as well, of the paper. Accordingly, the protection layer 53 is formed like a mat. Therefore, because of irregular reflection of that surface, it results that the image-receiving paper 100 has its luster lost.

When the image-receiving paper 100 is conveyed to the area under the line heater 11, the image-receiving paper 100 is pressed between the platen roller 10 and the line heater 11 in such a way that it is clamped between the both. The printer 1 causes the line heater 11 to generate heat until the temperature thereof becomes a softening temperature of the protection layer 53 and, conveys the image-receiving paper 100 using the platen roller 10. For this reason, the convex portions of the protection layer 53 are pressed while they are being heated by the heat generating portion 24*a*, with the result that the convex portions that have been softened are leveled. Accordingly, the concavo-convex portions of the protection layer 53 are made smooth, thereby it is possible to improve the luster of the post-printing image-receiving paper 100. The printer 1 can suitably be used for forming a print matter like a photograph and can also be applied to a photographic sealing machine as well.

The temperature of the heat generated from the line heater is set to, for example, 140° C. to 150° C. while the conveying speed of the platen roller 10 is set to 1000 mm/min. The conveying speed of the platen roller 10 and the generated-heat temperature of the heat generating portion 24*a* may each be fixed or made variable. The conveying speed of the platen roller 10 may be set to the same value as that of the conveying speed of the platen roller 4 or may be set to a different value from that of the conveying speed of the platen roller 4. When the conveying speed of the platen roller 10 is fast, the generated-heat temperature of the heat generating portion 24*a* may be set to a temperature that is higher than the temperature at which the protection layer 53 begins to soften, so that the protection layer 53 can be softened even in a short period of time.

For the protection layer 53, various kinds of material can be used. By imparting releasability to the protection layer 53, the protection layer 53 may be made easily separable from the heat generating portion 24*a* when mutual rub occurs between the heat generating portion 24*a* and the protection layer 53 Because of this, the accuracy of smoothing may be made high. When imparting releasability to the protection layer, an ordinary type of lubricant such as silicone oil, metal soap, or phosphate ester, and an ordinary type of resin such as polymethacrylic acid methyl may be used in combined form. Alternatively, resin material that has releasability in itself, such as silicone resin, may be used in independent form. Alternatively, silicone resin and lubricant may be used in combined form. Also, the material having at-heating releasability that exhibits releasability at the temperature at which the protection layer softens may be used.

The present invention is not limited to the above-described embodiment and permits various changes or modifications to be made so long as they are substantially the same as the technical idea of the invention.

The printing method is not limited to that in which sublimation heat-transfer is carried out. It may be the one in which melt heat-transfer is carried out, or the one in which heat-sensitive recording paper is rendered a color. It may be any method in which the protection layer is heated by the thermal head, thereby the concavo-convex portions are formed.

The heat generating portion 24*a* of the line heater 11 is not limited to the one that continuously extends over the entire width of the image-receiving paper 100. If that heat generating portion continuously extends over a length corresponding to some pieces of the heat generating portions 6*a* of the thermal head 6, it is possible to make the image-receiving paper 100 smooth. The line heater 11 is not limited to the one that is disposed so that it may intersect the feeding direction of paper at a right angle with respect thereto, and the line heater 11 may be disposed along the direction that is in coincidence with the feeding direction of paper. The line heater 11 is not limited to a thin-film type and a thick-film type of line heater may be used as that line heater 11.

The relative movement between the image-receiving paper 100 and line heater 11 may be realized by moving the line heater 11, or by moving both of the image-receiving paper 100 and the line heater 11.

According to the present invention, since the line heater is provided therein a single heat generating portion that has a length corresponding to a plurality of heat generating portions of the thermal head, it is possible, by disposing the line heater so that it may contact with the protective layer and, while causing generation of heat from its heat generating portion, relatively moving the line heater and the printing paper, to soften, flatten, and level the concavo-convex portions stated above. Accordingly, it is possible to make smooth the surface of the printing paper and therefore improve the luster of the printing paper. Furthermore, since using the line heater, comparing to the case where the roller for heating is used, there are various merits including that of enabling faster generation of heat, that of enabling lessening the power consumption, that of enabling miniaturizing the heater, and that of enabling making narrow the area of its being contacted with the printing paper and thereby increasing the pressure of pressing that paper.

What is claimed is:

1. A method of smoothing a protection layer on a surface of printing paper, the protection layer being formed on images of the printing paper by heat of a plurality of heat generating portions of a thermal head, which are arranged apart from each other, the method comprising the steps of:

disposing a line heater having a heat generating portion that continuously extends over a length corresponding to the plurality of heat generating portions of the thermal head, so that the heat generating portion of the line heater may contact the protection layer which is formed on the images by the thermal head; and relatively moving the line heater and the printing paper, while causing generation of heat from the heat generating portion of the line heater.

2. The method of smoothing the protection layer according to claim 1, wherein releasability is imparted to the protection layer.

3. An apparatus for smoothing a protection layer on a surface of printing paper, the protection layer being formed on images of the printing paper by heat of a plurality of heat generating portions of a thermal head, which are arrayed apart from each other, the apparatus comprising:

a line heater having a heat generating portion that continuously extends over a length corresponding to the plurality of heat generating portions of the thermal head and that is disposed so that the heat generating portion of the line heater may contact the protection layer which is formed on the images by the thermal head; and a device that relatively moves the line heater and the printing paper.

4. A printer comprising:

a thermal head having a plurality of heat generating portions arrayed apart form each other and forming a protection layer on images of printing paper by heat of the plurality of heat generating portions; and a line heater that, on a downstream side of the thermal head in the feeding direction of the printing paper, has a heat generating portion that continuously extends over a length corresponding to the plurality of heat generating portions of the thermal head, the heat generating portion of the line heater being disposed so as to contact the protection layer which is formed on the images by the thermal head.

5. The printer according to claim 4, wherein the line heater is provided so as to extend over an entire width of the printing paper.

* * * * *